United States Patent [19]

Kami et al.

[11] 4,135,296

[45] Jan. 23, 1979

[54] METHOD OF JOINING A FINE WIRE FILAMENT TO A CONNECTOR

[75] Inventors: Seiji Kami, Pacoima; Warren A. Stefferson, Canoga Park, both of Calif.

[73] Assignee: The United States of America as represented by the Secretary of the Air Force, Washington, D.C.

[21] Appl. No.: 826,106

[22] Filed: Aug. 19, 1977

[51] Int. Cl.[2] ..... H01R 43/00

[52] U.S. Cl. ..... 29/628; 29/517; 174/84 C

[58] Field of Search ..... 29/628, 517, 456; 339/276 T, 276 R, 276 D; 174/84 C, 94 R

[56] References Cited

U.S. PATENT DOCUMENTS

| | | | |
|---|---|---|---|
| 2,262,802 | 11/1941 | Hayden | 339/276 T |
| 2,490,809 | 12/1949 | Holke | 174/94 R |
| 3,110,755 | 11/1963 | Esser | 174/84 C X |
| 3,440,333 | 4/1969 | Blomstrand | 29/628 X |
| 3,475,545 | 10/1969 | Stark et al. | 174/84 C X |
| 3,927,471 | 12/1975 | Tricker | 29/628 X |

FOREIGN PATENT DOCUMENTS

| | | | |
|---|---|---|---|
| 229040 | 12/1943 | Switzerland | 174/94 R |

*Primary Examiner*—Victor A. DiPalma
*Attorney, Agent, or Firm*—Joseph E. Rusz; Arsen Tashjian

[57] ABSTRACT

Fine diameter wires especially suited for high temperature filaments are physically and electrically held in simple cylindrical connectors by lining the inside of the connector with a closely wound wire coil, inserting the fine wire into the center of the coil, and lightly crimping the outer surface of the connector until the filament wire is electrically joined to the connector and firmly held therein without the filament being weakened or excessively stressed.

2 Claims, 3 Drawing Figures

METHOD OF JOINING A FINE WIRE FILAMENT TO A CONNECTOR

STATEMENT OF GOVERNMENT INTEREST

The invention described herein may be manufactured and used by or for the Government for governmental purposes without the payment of any royalty thereon.

BACKGROUND OF THE INVENTION

This invention relates to a method of making an electrical connection of a fine wire or single filament to a cylindrical connector and, more particularly, the invention is concerned with providing a method of attaching a high temperature filament to a cylindrical connector by inserting a coiled wire into the connector to reduce the initial diameter, slipping the filament into the center of the coiled wire and lightly crimping the cylindrical connector.

Heretofore, it has been common practice to attach fine diameter wires and filaments by spot welding the filament to the filament holder or, in the alternative, to provide specially designed filament holders. These previous techniques generally result in damage to the fine diameter wires and filaments and cause highly stressed areas which produce stress concentrations at the joint. This condition usually results in early joint failure. Other attachment techniques such as clamping, brazing, twisting or wrapping, also cause the filament to be highly stressed and reduced in cross section producing early joint failure. Since the cylindrical end of nearly all commercially available connectors is much too large a diameter for the fine wire or filament to be attached with light pressure, some other means of attachment is required.

It would be most desirable to reduce the diameter of the tubular portion of the cylindrical connector by filling the portion of the volume with an element which will operate to hold the filament firmly in place and electrically joined without weakening the filament. This requires that the filament be gripped over a relatively long length and that a tight fit be obtained with a very light crimping of the outer cylinder, thereby avoiding high stress concentrations making the joint as strong as the wire filaments.

SUMMARY OF THE INVENTION

This invention is concerned with providing a method of joining a fine wire filament to a cylindrical connector by lining the inside of the connector with a closely wound wire coil to reduce the diameter of connector, inserting the fine wire filament into the center of the wire wound coil so that the inner diameter of the coil is substantially filled, and lightly crimping the outer surface of the connector until the filament in the center of the coiled wire is firmly held and electrically joined to the connector. A relatively tight fit can be obtained with very light crimping of the outer cylindrical connector if the wire diameter of the wound coil is chosen to fit closely in the cylinder. The gripping force on the wire filament is distributed over a relatively long length compared to wire filament diameter thereby avoiding sharp cross-section discontinuities. This prevents high stress concentrations and produces a joint as strong as the wire filament itself.

Accordingly, it is an object of the invention to provide a method of joining a fine wire filament to a cylindrical connector without spot welding, clamping, brazing, wrapping or twisting the filament thereby avoiding severe cross section discontinuities and high stress concentrations which would result in early joint failures.

Another object of the invention is to provide a method of making an electrical connection of a high temperature fine wire filament to a standard cylindrical connector by first inserting a wire wound coil spacer into the cylinder, inserting the fine wire filament into the coil spacer, and lightly crimping the cylindrical connector causing the coil to press inward gripping the wire filament and preventing the connection from coming apart.

Still another object of the invention is to provide a simple method of physically and electrically joining a fine diameter wire and/or filament to a commercial crimp type terminal lug by lining the inside of the terminal lug with a closely wound wire coil, slipping the fine wire inside the coil and then crimping the terminal lug in the customary manner.

A further object of the invention is to provide a method of joining fine wire filaments to cylindrical connectors wherein a tight fit can be obtained with very light crimping of the outer surface of the connector so that the filament is firmly held and electrically connected without weakening the filament.

A still further object of the invention is to provide a method of joining a fine wire filament subjected to very high temperature to a cylindrical connector wherein a wire coil is used to fill the space between the filament and the connector in a uniform manner so that light crimping of the outer cylinder grips the wire filament with a gradually imposed squeeze to prevent severe cross section discontinuities.

These and other objects, features and advantages will become more apparent after considering the following detailed description taken in conjunction with the annexed drawings and appended claims.

DESCRIPTION OF A PREFERRED EMBODIMENT

Figure 1:
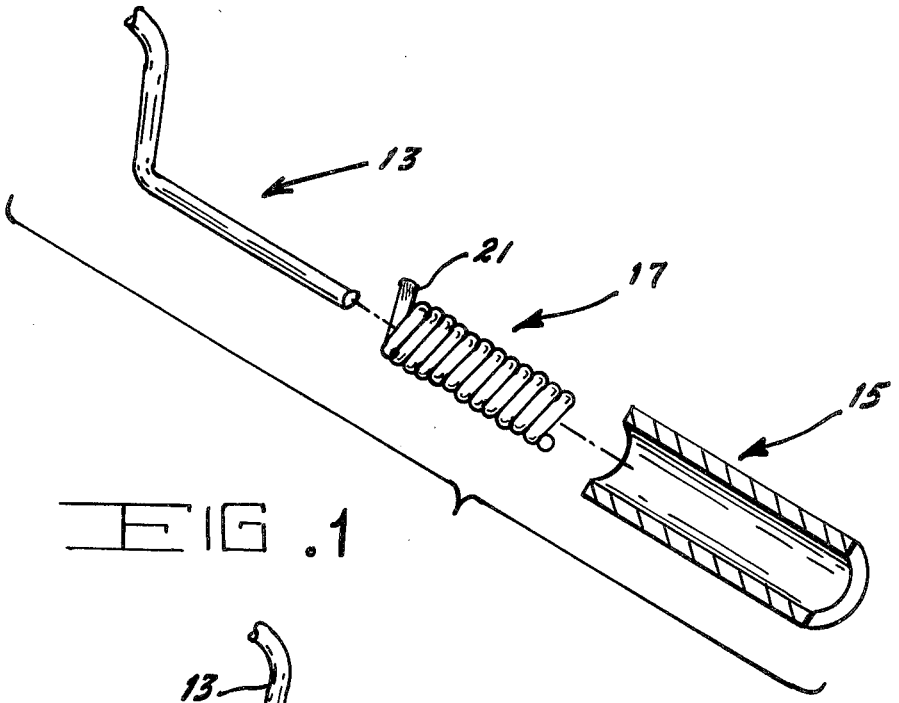
FIG. 1 is an exploded view in partial section of the joint according to the invention showing the fine wire filament, wire wound coil lining and cylindrical connector.
Figure 2:
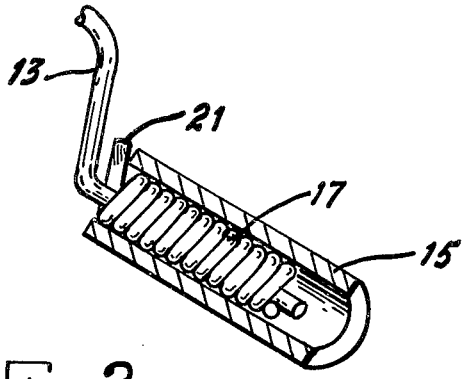
FIG. 2 is a view in partial section of the joint according to the invention assembled with the fine wire filament and wire wound coil in position in the cylindrical connector.
Figure 3:
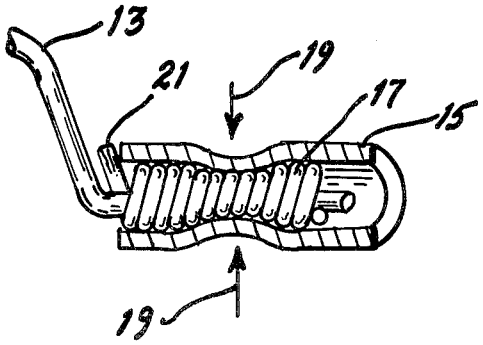
FIG. 3 is a view in partial section of the assembled joint after crimping the cylindrical connector to provide an electrical connection with the fine wire filament without producing any areas of high stress concentration therein.

Referring now to the drawings wherein like reference numerals refer to like elements in the several views, in FIG. 1 there is shown an exploded view of the electrical connector according to the invention. A fine wire or filament 13 is shown greatly enlarged. In practice the filament 13 is very small in diameter compared to the inside diameter of the cylindrical connector 15. A wire wound coil 17 is slipped into the connector 15 to fill the open space within the retaining cylinder 15 uniformly around the filament or wire 13. Light crimping as indicated by the arrows 19 in FIG. 3 on the outer surface of the cylinder 15 grips the wire filament 13 with a gradually imposed squeeze. This avoids severe cross section discontinuities, thus resulting in a gradually applied squeezing force on the wire filament 13.

Previous techniques have been to spotweld the filament or to make specially designed filament holders. These techniques generally result in damaging the fine diameter filaments and wires because of an abrupt decrease and distortion of the wire cross section. The addition of the wound coil 17 allows any convenient cylinder 15 to be used. The wire diameter of the coil 17 can be varied to suit the cylinder 15 so that a relatively tight fit can be obtained with very light crimping 19 of the outer cylinder 15. The grip of the wire filament 13 occurs over a relatively long length compared to the diameter of wire filament 13 avoiding sharp cross section discontinuities and high stress concentrations making the joint as strong as the wire filaments 13.

The invention is particularly well suited for the manufacture of a high temperature ion beam neutralizer. When used for this purpose, the filament 13 is doped tantalum wire 0.007 inch diameter and 2.0 inches long. The wire wound coil 17 is made by winding a helical coil over a 0.010 inch diameter mandrel and terminating in a short straight tail 21 which is 0.020 inches long. The cylindrical support tube is 0.041 outside diameter and 0.025 inside diameter and 0.750 inches long.

The helical wire wound coil spacer 17 is inserted into the support tube connector 15 until the tail 21 rests on the end of the connector 15. The filament 13 is then inserted through the center of the spacer 17-support tube 15 assembly. The support tube 15 and spacer 17 is crimped lightly with wire bending pliers or the like until the filament 13 is securely held and electrically joined. The joint strength can be simply tested on a sample by pulling on the filament 13 and noting where it fails. In all of the samples tested, the filament 13 failed in an area other than the joint.

Although the invention has been illustrated in the foregoing specification in terms of a preferred embodiment thereof, the invention is not limited to this embodiment or to the particular configuration shown and described. It will be apparent to those skilled in the art that certain changes, modifications and substitutions can be made, particularly with respect to the shape and positioning of the elements without departing from the true spirit and scope of the appended claims. For example, although the invention is described for use in an ion beam neutralizer, it can be seen that it would be equally well suited for any high temperature filament application such as in an electric filament lamp or the like.

Having thus set forth the nature of our invention, what we claim and desire to secure by Letters Patent of the United States is:

1. The method of joining a fine wire filament to an open ended cylindrical connector comprising the steps of inserting a closely wound helical wire coil into the open end of the cylindrical connector, inserting the wire filament into said wound helical wire coil, and lightly crimping a limited area of the portion of said cylindrical connector having said wire coil therein to physically attach and electrically connect said wire filament to said cylindrical connector without any severe discontinuities and areas of stress concentration in said filament wire.

2. The method of joining a fine wire filament to an open ended cylindrical connector defined in claim 1 wherein said closely wound helical wire coil is inserted to its full length into said cylindrical connector such that a tail extending outwardly from one end of said helical wire coil rests against the edge of the open end of said cylindrical connector.

* * * * *